US005498080A

United States Patent [19]

Dalea et al.

[11] Patent Number: 5,498,080

[45] Date of Patent: Mar. 12, 1996

[54] EASILY EXPANDABLE, FLEXIBLE PAPER POPCORN PACKAGE

[75] Inventors: Lisa M. Dalea, Maple Grove; Robert L. Esse, Monticello; Francis M. Shee, Brooklyn Park, all of Minn.

[73] Assignee: General Mills, Inc., Minneapolis, Minn.

[21] Appl. No.: 307,126

[22] Filed: Apr. 16, 1994

[51] Int. Cl.[6] ..... B65D 30/20

[52] U.S. Cl. ..... 383/120; 219/727

[58] Field of Search ..... 383/120; 219/727

[56] References Cited

U.S. PATENT DOCUMENTS

| | | | |
|---|---|---|---|
| 43,567 | 7/1864 | Campbell | 383/10 |
| 670,360 | 3/1901 | Lawler | 383/7 |
| 1,733,219 | 10/1929 | Duvall . | |
| 3,023,947 | 3/1962 | McDuffie | 426/111 |
| 4,367,842 | 1/1983 | Rausing . | |
| 4,553,010 | 11/1985 | Bohrer et al. . | |
| 4,571,337 | 2/1986 | Cage et al. . | |
| 4,691,374 | 9/1987 | Watkins et al. | 383/104 |
| 4,806,371 | 2/1989 | Mendenhall | 426/113 |
| 4,812,055 | 3/1989 | Prader et al. | 383/120 |
| 4,851,246 | 7/1989 | Maxwell et al. . | |
| 4,864,090 | 9/1989 | Maxwell et al. | 383/211 |
| 4,913,561 | 4/1990 | Beer | 383/120 |
| 4,973,810 | 11/1990 | Brauner | 219/10.55 E |
| 5,011,299 | 4/1991 | Black, Jr. et al. | 219/10.55 E |
| 5,044,777 | 9/1991 | Watkins et al. | 383/100 |
| 5,189,272 | 2/1993 | McDonald et al. . | |
| 5,195,829 | 3/1993 | Watkins et al. | 383/120 |
| 5,326,576 | 7/1994 | Zuege | 383/120 |

FOREIGN PATENT DOCUMENTS 9222475 12/1992 WIPO .

*Primary Examiner*—Stephen P. Garbe

*Attorney, Agent, or Firm*—L. MeRoy Lillehaugen; John A. O'Toole; Alan D. Kamrath

[57] ABSTRACT

A flexible paper popcorn package in the form of an easily expandable bag (18) is disclosed including a bottom wall (20), a top wall (22), first and second, pleated, side walls (26), a first non-opening end (24), and a second, peelable end (28). The ends (24, 28) are sealed by constant width adhesive strips (46, 48) located on the inside surfaces of the sheet (42) forming the tubular stock for the bag (18) and which adhere the inside surfaces of the pleats (26*a–d*) to the top and bottom walls (20, 22) and adhere the top and bottom walls (20, 22) together intermediate the inner edges of the pleats (26*a–d*). The outside surfaces of the pleats (26*a–d*) are bonded together by constant width tuck strips (50) extending from the inner edges of the pleats (26*a–d*) towards but substantially spaced from the outer edges of the pleats (26*a–d*) connected to the top and bottom walls (20, 22) and overlain by the adhesive strip (46) of the first end (24) for ensuring that the first end (24) does not vent by releasing the adhesive strip (46) while the popcorn kernels are popping in the microwave oven.

9 Claims, 4 Drawing Sheets

EASILY EXPANDABLE, FLEXIBLE PAPER POPCORN PACKAGE

BACKGROUND

The present invention relates generally to packages for use in microwave ovens, and pertains more particularly to an easily expandable flexible popcorn package.

To conserve space during shipping and storage, microwave popcorn packages are folded flat with the gussets being closed. During popping by use of microwave energy, the popcorn package expands opening the gussets, with the expansion due to the internal pressure of the steam produced by the popping of the popcorn kernels, the pressure of the popped kernels themselves, as well as other factors. An important feature for maximizing the volume of the popped kernels is the ability of the microwave popcorn package to easily expand. Another important factor for maximizing the volume of the popped kernels is that the number of kernels which are actually popped be maximized by insuring that the unpopped kernels are located on the susceptor with sufficient dwell time to receive sufficient heat energy to result in popping. The ends of the bag play an important role in the ability of the bag to expand as well as the ability of unpopped kernels to travel to the susceptor. Typically only one end of the bag is closed by a peelable seal whereas the other end is closed by a non-opening permanent seal constructed so as to seal adequately the vapor created within the microwave popcorn package during the heating thereof in the microwave oven as well as to prevent undesired opening during the consumption of the popped kernels. One type of end has a flat rectangular or square configuration of the grocery store bag style. However, most conventional popcorn packages utilize a folded end, with folded end packages typically resulting in greater volumes of popped kernels than for flat configuration end packages. However, it can immediately be appreciated that such folded end packages have restricted ability to open the gussets adjacent to the end, with the gussets adjacent the end forming crevices which are at least initially prone to hold unpopped kernels and thus reducing their potential dwell time with the susceptor.

Other microwave popcorn packages have been utilized with varying degrees of success to overcome these problems, but they also encounter several disadvantages. Specifically, typically such packages include large areas of adhesive. Large areas of adhesive can restrict the flexibility of the walls of the package. Further, for any given size of sheet of paper forming the microwave package, the use of larger areas of adhesive reduce the available volume for the popped kernels in the microwave package. Additionally, the use of more adhesive increases costs because of increased materials needed.

Thus, a need continues to exist for an improved flexible paper popcorn package which is easily expandable by the dynamics involved in popping the kernels and which is less likely to capture unpopped kernels during the expansion of the package while subjected to microwave energy.

Surprisingly, the above need and other objectives can be satisfied by providing, in the preferred form, an expandable, paper, popcorn package in the form of a pleated bag, wherein tuck spots or strips are provided for bonding the outside surfaces of the pleats together adjacent to the end and spaced from the outer edges of the pleats for ensuring that the lower end of the bag when held in an upright position does not vent by releasing the securement of the inside surfaces of the pleats to the top and bottom walls and of the top and bottom walls while the popcorn kernels are popping in the microwave oven or while the popped popcorn is being consumed from the bag.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where:

FIG. 2 shows a cross-sectional view of the package of FIG. 1 according to section line 3—3 of FIG. 1.

Figure 1:
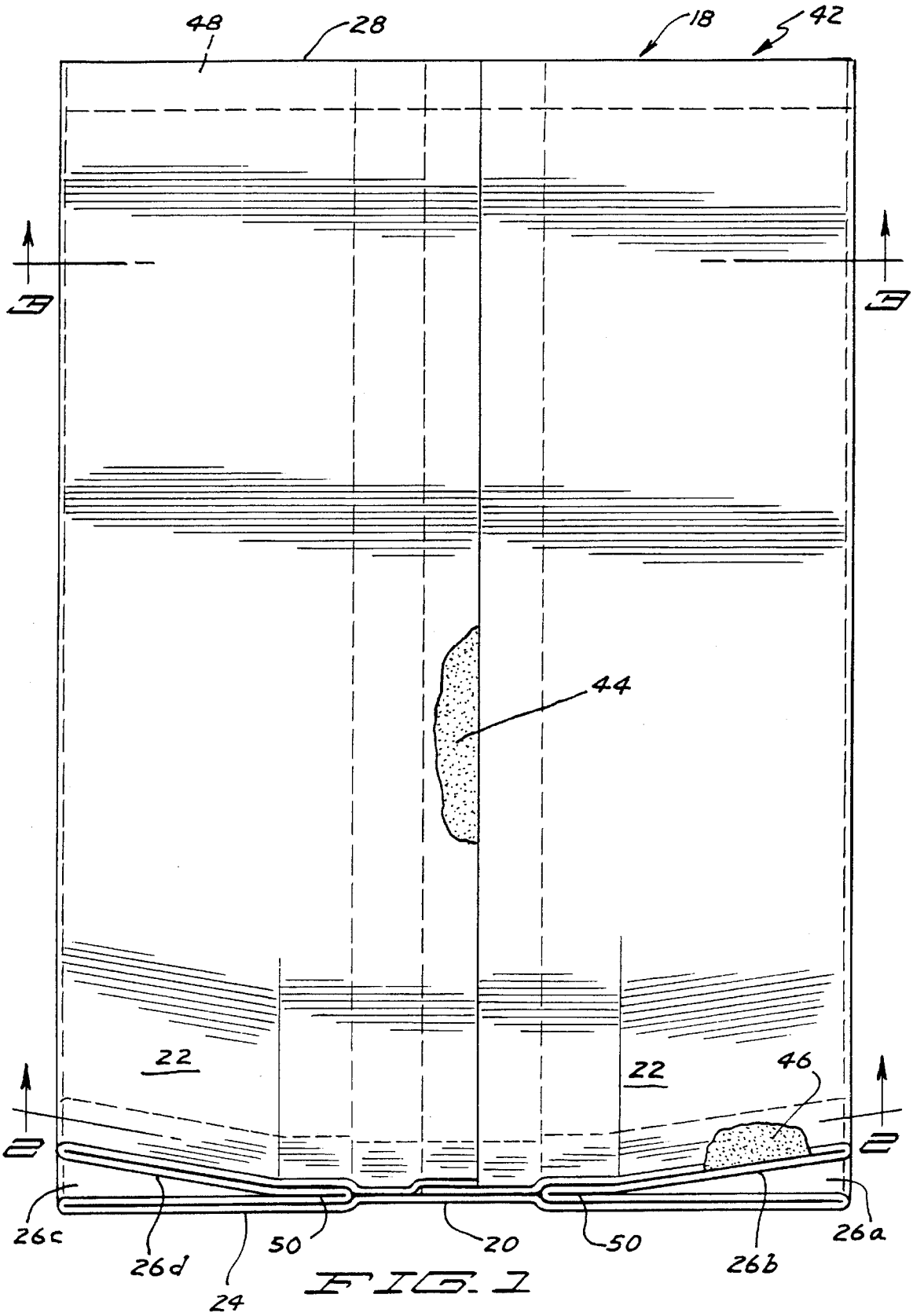
FIG. 1 shows a perspective view of a package fabricated in accordance with the preferred teachings of the present invention in generally a collapsed, flat condition, but illustrated slightly expanded to show constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

A package for use in microwave ovens according to the preferred teachings of the present invention is shown as an expandable, flexible bag in the drawings and generally designated 18. It will facilitate the ensuing description to consider bag 18 in the horizontal position when placed in the microwave oven as opposed to a vertical or upright position when the contents of bag 18 are being consumed by the consumer. Therefore, bag 18 includes a bottom wall 20, a top wall 22, a first end 24, side walls 26 and a second end 28. In the preferred form, the width of bottom wall 20 is equal to the width of top wall 22, although the widths of walls 20 and 22 could be different.

In the most preferred form, side walls 26 include gussets or pleats **26*a*, 26*b*, 26*c* and 26*d* that enable side walls 26 to expand during a heating cycle. Particularly, in the preferred form, pleats 26*a* and 26*b* are connected together at first, inner edges and have second and third, opposite, outer edges connected to bottom wall 20 and top wall 22, respectively. Likewise, pleats 26*c* and 26*d* are connected together at fourth, inner edges and have fifth and sixth, opposite, outer edges connected to bottom wall 20 and top wall 22, respectively. In the preferred form, in its collapsed condition, pleats 26***a* and 26*c* have the same width and overlie bottom wall 20, and pleats 26*b* and 26*d* have the same width which is equal to the width of pleats 26*a* and 26*c* and overlie pleats 26*a* and 26*c*, with top wall 22 overlying pleats 26*b* and 26*d*. In the preferred form, bottom and top walls 20 and 22 have a width extending beyond the inner, interconnected edges of pleats 26*a* and 26*b* and of pleats 26*c* and 26*d* when bag 18 is in its collapsed or folded condition. The first and second, free ends of pleats 26*a*, 26*b*, 26*c* and 26*d* the first and second, free ends of bottom wall 20, and the first and second, free ends or top wall 22 are co-planar, and have the same extent or length.

Attention is now directed to a susceptor patch 30 that extends over a portion of bottom wall 20 spaced from ends 24 and 28. Susceptor patch 30 can be formed in any suitable manner known in the art such as a metalized plastic film adhered to bottom wall 20, as a paper backed susceptor, or as a coating, applied or printed to bottom wall 20. Further, although susceptor patch 30 is shown as overlying bottom wall 20 and thus located inside of bag 18, susceptor patch 30 can be located outside of bag 18 with bottom wall 20 overlying susceptor patch 30. Further, placement of susceptor patch 30 can occur at the material convertor or on the manufacturing lines.

It can then be appreciated that bag 18 can be manufactured as current bags are manufactured for example of the type shown and described in U.S. Pat. Nos. 4,450,180; 4,691,374; 4,735,513; 4,878,765; or 5,044,777. In this regard, bag 18 can be formed by cutting a web of material to length to form a sheet 42 and folding that sheet 42 to form the tubular bag stock including bottom, top, and side walls 20, 22, and 26. It should also be noted that the ends of bottom, top, and side walls 20, 22, and 26 are all of the same length and specifically do not require any special cuts and/or do not require extra components to form tabs or flaps. In the most preferred form of the present invention, a suitable adhesive strip 44 is added during formation at the overlapping edges of sheet 42 to form a longitudinally extending lap seal to create the tubular bag stock. The lap seal is of a constant width and extends the full length between the first and second ends of top wall 22.

According to the preferred teachings of the present invention, first and second adhesive strips 46 and 48 are preapplied on the inside surface of sheet 42 prior to its formation as a tubular bag stock and extend inwardly from the ends of sheet 42. Strips 46 and 48 and their inside edges are parallel to the ends of sheet 42 and each other. Strips 46 and 48 can be of the same or different widths substantially less than the length between the first and second ends of bottom, top and side walls 20, 22, and 26, with the widths of strips 46 and 48 being constant in the most preferred form. Strips 46 and 48 extend the full width of sheet 42 between the edges thereof which are overlapped to create the tubular bag stock. The outside surface of sheet 42 further includes first and second adhesive tuck spots or strips 50 which are preapplied to sheet 42 prior to its formation as a tubular bag stock and which are of a length greatly less than the width of sheet 42 between the edges which are overlapped to create the tubular bag stock and in the most preferred form which are one-half of the widths of any one of pleats 26*a*, 26*b*, 26*c* and 26*d*. Strips 50 extend inwardly from the ends of sheet 42, with strips 50 and their inside edges being parallel to the ends of sheet 42. Strips 50 have constant and equal widths which are substantially equal to the width of strip 46 and in the most preferred form slightly less than the width of strip 46. Strips 50 are positioned to be overlain by strip 46 and extend equadistance on opposite sides of the first, connected edges of pleats 26*a* and 26*b* and the fourth, connected edges of pleats 26*c* and 26*d*.

It should be noted that strips 46, 48, and 50 in the most preferred form are preferably formed from a thermoplastic adhesive which with the application of heat and pressure will adhere to itself and/or sheet 42. However, it can be appreciated that strips 46, 48, and 50 can be formed from any suitable material which provides a secure bond therebetween.

End 24 provides a non-opening permanent seal to the first end of bag 18 which forms the lower end of bag 18 when held in its upright position when the contents of bag 18 are being consumed by the consumer. Particularly, in the most preferred form, pressure and heat are applied to the first end of the folded, tubular bag stock to adhere strips 46 and 50. It can then be appreciated that strip 46 adheres and seals the inside surface of pleat 26*a* to the inside surface of bottom wall 20, adheres and seals the inside surface of pleat 26*c* to the inside surface of bottom wall 20, adheres and seals the inside surface of pleat 26*b* to the inside surface of top wall 22, and adheres and seals the inside surface of pleat 26*d* to the inside surface of top wall 22. Further, strip 46 adheres and seals bottom wall 20 to top wall 22 intermediate the inner, interconnected edges of pleats 26*a* and 26*b* and of pleats 26*c* and 26*d*. It can be also appreciated that first strip 50 adheres the outside surface of pleat 26*a* to the outside surface of pleat 26*b* from their first, connected edges to a point spaced from their second and third edges. Likewise, second strip 50 adheres the outside surface of pleat 26*c* to the outside surface of pleat 26*d* from their third, connected edges to a point spaced from their fifth and sixth edges.

End 28 provides a peelable closure seal which fails during microwave cooking adjacent the second, free ends of bottom, top and side walls 20, 22, and 26 or in other words, adjacent the second end of bag 18 which forms the upper end of bag 18 when held in its upright position when the contents of bag 18 are being consumed by the consumer. This peelable seal failure allows trapped steam to vent from the package, as well as allowing the consumer to open bag 18 after microwave cooking and prior to eating. Particularly, it can be appreciated that bag 18 can be filled with the desired food product as current bags are filled for example of the type shown and described in U.S. Pat. No. 4,450,180. After filling, strip 48 can be adhered to walls 20, 22, and 26 utilizing standard equipment presently utilized to form the peelable seal of current bags. Specifically, in the most preferred form,, pressure and heat are applied to the second end of the filled bag 18 to adhere strip 48. It can then be appreciated that strip 48 adheres and seals the inside surface of pleat 26*a* to the inside surface of bottom wall 20, adheres and seals the inside surface of pleat 26*c* to the inside surface of bottom wall 20, adheres and seals the inside surface of pleat 26*b* to the inside surface of top wall 22, and adheres and seals the inside surface of pleat 26*d* to the inside surface of top wall 22. Further, strip 48 adheres and seals bottom wall 20 to top wall 22 intermediate the inner, interconnected edges of pleats 26*a* and 26*b* and of pleats 26*c* and 26*d*. It of course should be appreciated that the particular manner of manufacture and filling of bag 18 can be done in a variety of ways and manners such as but not limited to the example set forth above.

For the sake of completeness, it will be assumed that the contents of bag 18 are popcorn kernels having been popped when in the microwave oven. Particularly, as with current bags, bag 18 in a collapsed condition is placed in a microwave oven with bottom wall 20 resting upon the bottom surface of the oven cavity. When subjected to microwave energy, susceptor patch 30 converts microwave energy into heat, with the heat and remaining microwave energy causing the popping of the kernels and the creation of water vapor. The water vapor and heated air cause side walls 26 to expand to extend from their connecting edges at an angular relation to each other and the inside surfaces of pleats 26*a*, 26*b*, 26*c*, and 26*d* being spaced from the inside surfaces of bottom and top walls 20 and 22, expanding bag 18 and increasing the interior volume inside of bag 18 for the popped kernels. It can then be appreciated that due to its flexible nature, bag 18 will expand to a football like shape, including separating pleats 26*a* and 26*b* and pleats 26*c* and 26*d* adjacent to the first and second ends of bottom, top and side walls 20, 22, and 26.

Bag 18 according to the preferred teachings of the present invention is advantageous over prior bags. Particularly, end 24 according to the teachings of the present invention generally does not vent while the popcorn kernels are popping in the microwave oven or during consumption of the popped popcorn. In particular, the separation forces at end 24 and/or 28 are greatest at the center intermediate the first and fourth, inner edges of pleats 26*a*, 26*b*, 26*c*, and 26*d* where top wall 22 is secured to bottom wall 24 in the most preferred form. Although restricting expansion of pleats 26*a*, 26*b*, 26*c*, and 26*d* somewhat, tuck strips 50 provide additional strength at the center of end 24 for ensuring that end 24 does not vent by releasing adhesive strip 46 while the popcorn kernels are popping in the microwave oven. It can then be appreciated that the use of tuck strips 50 according to the preferred teachings allows the size of strip 46 to be minimized which has several advantages. First, the amount of adhesive required for strip 46 is reduced, thus reducing material costs. Further, the reduced width of strip 46 maximizes the total volume for bag 18 for the same size sheet 42. Additionally, the reduced amount of adhesive minimizes the restriction of flexibility of walls 20, 22, and 26.

Furthermore, it can be appreciated that pleats 26*a*, 26*b*, 26*c*, and 26*d* are generally allowed to separate closer to end 24 than prior folded end packages. Specifically, prior folded end packages secured the entire end of the bag in a flat, folded condition such that the pleats could not unfold at all at the first end and also tended to have very gradually increasing volume from the first end. According to the teachings of the present invention, pleats 26*a* and 26*c* are generally allowed to unfold from pleats 26*b* and 26*d*, respectively, (aside from the length bonded together by tuck strips 50 which in the most preferred form is about 25% of the length of the connected edges of pleats 26*a* and 26*b* and of pleats 26*c* and 26*d* to their edges which are connected to walls 20 and 22) such that increased expansion and interior volume of bag 18 is possible. Due to the ability to increase expansion, the size of the pleat volume from the first end increases relatively rapidly such that there is less tendency to create crevices which are prone to hold unpopped kernels. It can be appreciated that the ability to expand and the interior volume of bag 18 can be maximized by minimizing the length of tuck strips 50 from the connected edges of pleats 26*a* and 26*b* and of pleats 26*c* and 26*d*, with the minimum length of tuck strips 50 being limited to an amount which insures their ability to avoid venting of end 24.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Expandable, paper, popcorn package for holding popcorn kernels for popping in a microwave oven comprising, in combination: a bag having a folded condition and an expanded condition and including first and second ends, a bottom wall, a top wall, and at least a first side wall defining an interior, with the first side wall including first and second pleats, with the first pleat having first and second edges, an inside surface and an outside surface, with the second pleat having first and third edges, an inside surface and an outside surface, with the first edges of the first and second pleats being connected together, with the second edge being connected to the bottom wall, with the third edge being connected to the top wall, with the inside surface of the first pleat abutting with the bottom wall, the inside surface of the second pleat abutting with the top wall, and the outside surface of the second pleat abutting with the outside surface of the first pleat in the folded condition; means for sealing the first end including means for securing the inside surface of the first pleat to the bottom wall and for securing the inside surface of the second pleat to the top wall; and means for bonding the outside surface of the second pleat to the outside surface of the first pleat adjacent to the first end but spaced from the second and third edges for ensuring that the first end of the bag does not vent by releasing the first end sealing means while the popcorn kernels are popping in the microwave oven and for allowing unfolding of the first and second pleats from each other at the first end.

2. The expandable, paper, popcorn package of claim 1 wherein the bonding means extends from the first edges towards but spaced from the second and third edges.

3. The expandable, paper, popcorn package of claim 1 wherein the bag includes a second side wall having third and fourth pleats, with the third pleat having fourth and fifth edges, an inside surface, and an outside surface, with the fourth pleat having fourth and sixth edges, an inside surface, and an outside surface, with the fourth edges of the third and fourth pleats being connected together, with the fifth edge being connected to the bottom wall, with the sixth edge being connected to the top wall, with the inside surface of the third pleat abutting with the bottom wall, the inside surface of the fourth pleat abutting with the top wall, and the outside surface of the fourth pleat abutting with the outside surface of the third pleat in the folded condition; wherein the sealing means includes means for securing the inside surface of the third pleat to the bottom wall and for securing the inside surface of the fourth pleat to the top wall; and wherein the expandable, paper, popcorn package further comprises, in combination: means for bonding the outside surface of the third pleat to the outside surface of the fourth pleat adjacent to the first end but spaced from the fifth and sixth edges for ensuring that the first end of the bag does not vent by releasing the first end sealing means while the popcorn kernels are popping in the microwave oven and for allowing unfolding of the third and fourth pleats from each other at the first end.

4. The expandable, paper, popcorn package of claim 3 wherein the first and fourth edges are spaced, with the first edge located intermediate the second edge and the fourth edge, with the sealing means further including means for securing the top wall to the bottom wall intermediate the first and fourth edges.

5. The expandable, paper, popcorn package of claim 1 wherein the bonding means is in the form of a tuck spot having an inside edge parallel to the first end.

6. The expandable, paper, popcorn package of claim 5 wherein each of the securing means is in the form of a strip having an inside edge parallel to the first end.

7. The expandable, paper, popcorn package of claim 6 wherein the tuck spot is overlain by the strips of the first and second pleats.

8. The expandable, paper, popcorn package of claim 5 wherein the bonding means extends from the first edges towards but spaced from the second and third edges.

9. The expandable, paper, popcorn package of claim 1 further comprising, in combination: means for sealing the second end including means for securing the inside surface of the first pleat to the bottom wall and for securing the inside surface of the second pleat to the top wall.

* * * * *

UNITED STATES PATENT AND TRADEMARK OFFICE

CERTIFICATE OF CORRECTION

PATENT NO. : 5,498,080

DATED : March 12, 1996

INVENTOR(S) : Lisa M. Dalea, Robert L. Esse, Francis M. Snee

Figure 3:
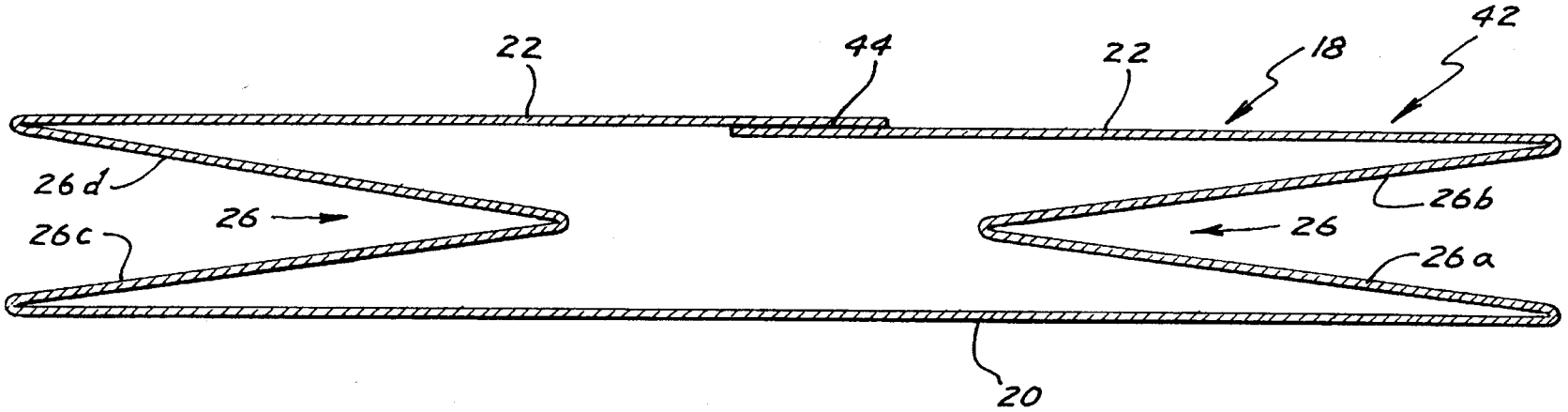
Figure 2:
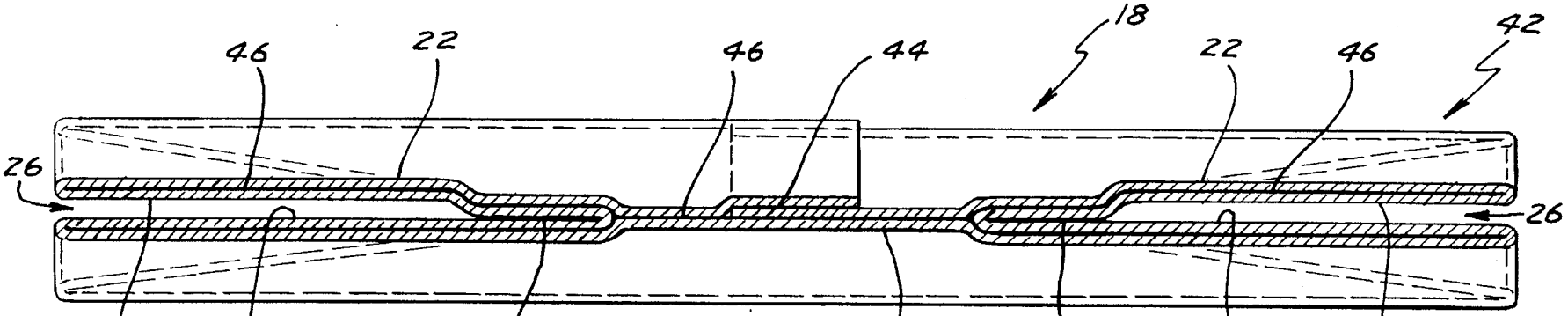
FIG. 2 shows a cross-sectional view of the package of FIG. 1 according to section line 2—2 of FIG. 1.
Figure 4:
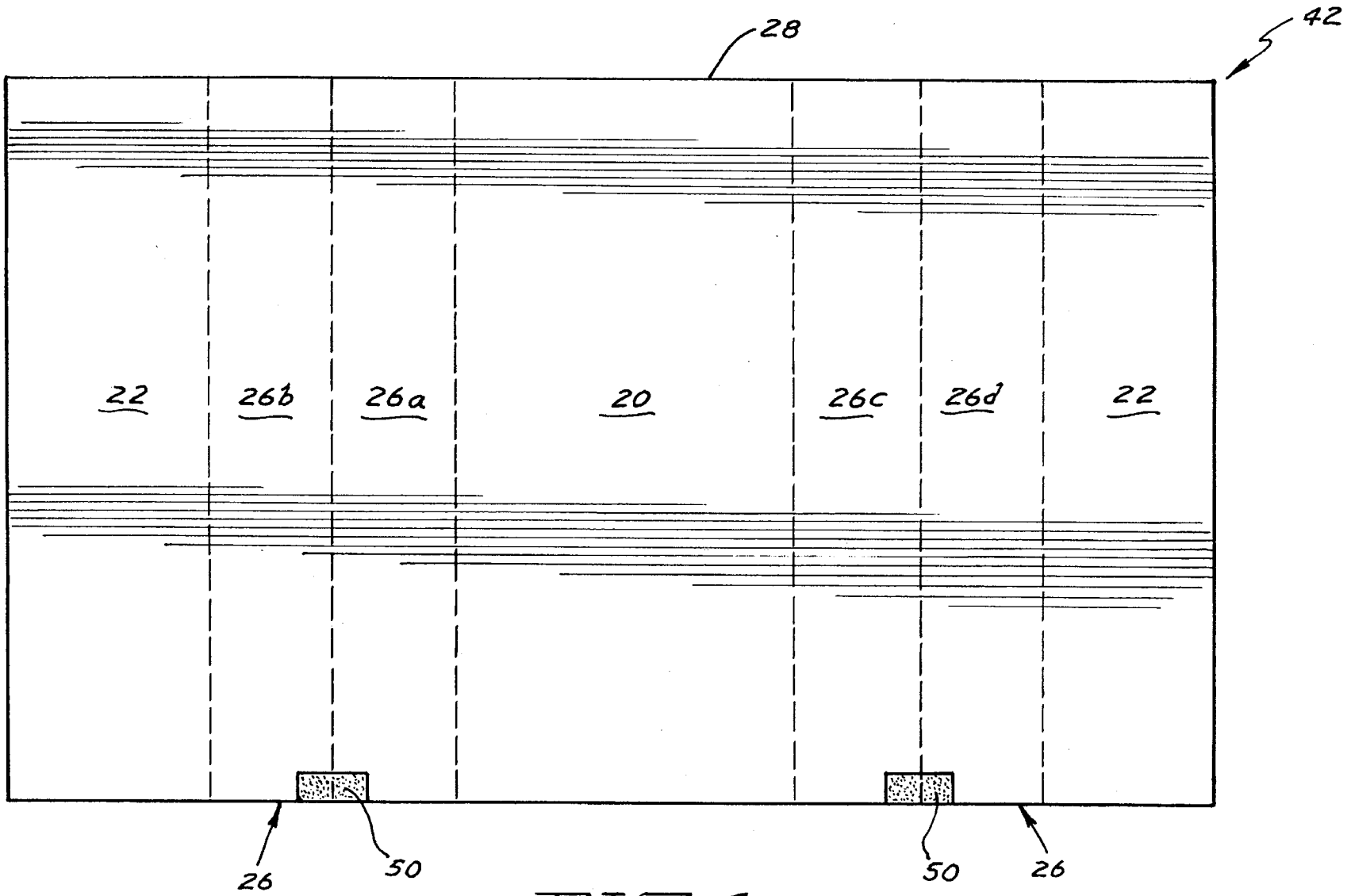
FIG. 4 shows a plan view of the outside surface of the sheet forming the package of FIG. 1.
Figure 5:
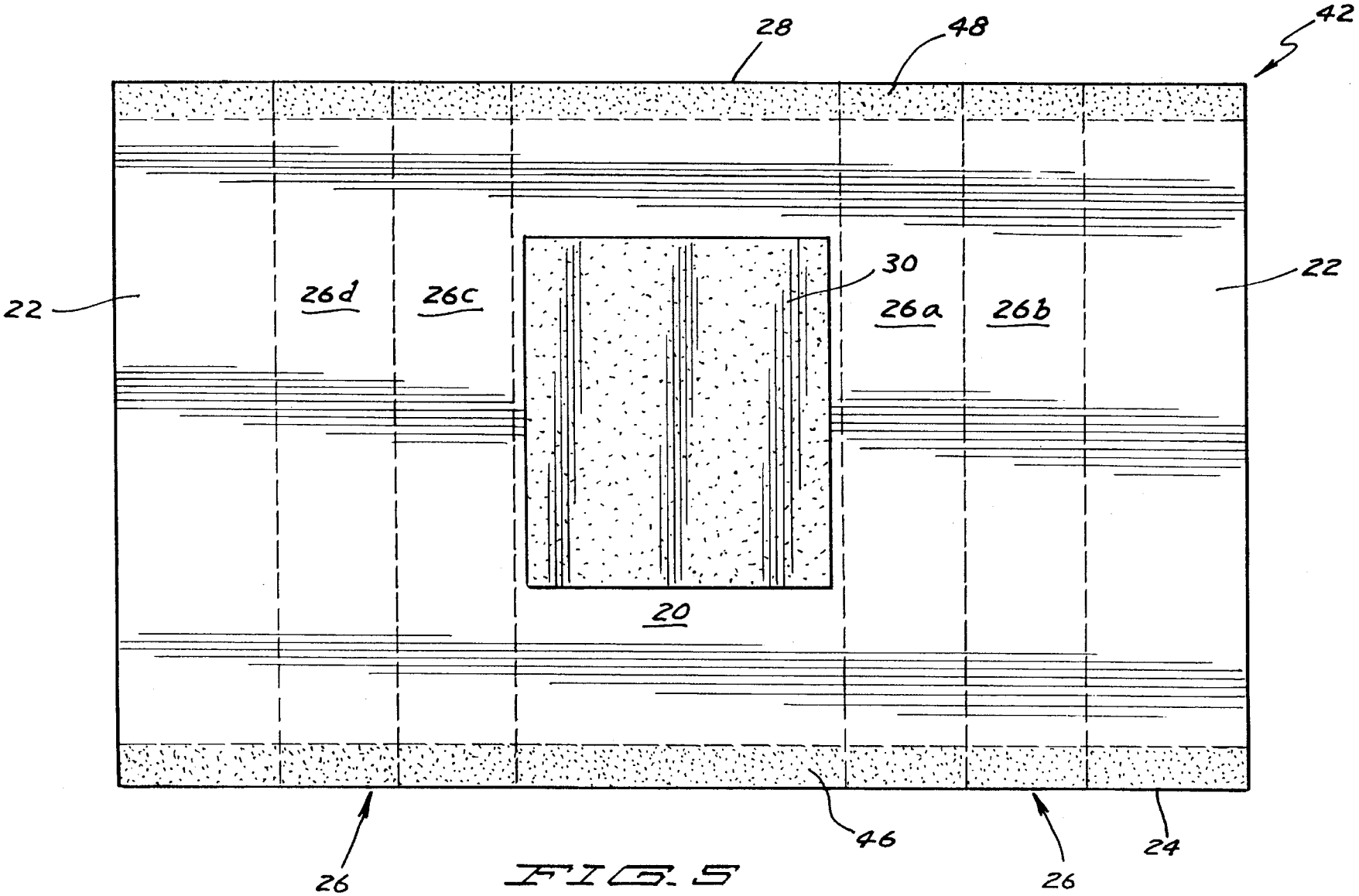
FIG. 5 shows a plan view of the inside surface of the sheet forming the package of FIG. 1.

It is certified that error appears in the above-identified patent and that said Letters Patent is hereby corrected as shown below:

On the title page, item [75], Inventor "Francis M. Shee" should be -- Francis M. Snee --;

Col. 2, line 18; "FIG. 2" should be -- FIG. 3 --;

Col. 3, line 12; "26d the" should be -- 26d, the --;

Col. 3, line 14; "ends or top" should be -- ends of top --;

Col. 4, line 50; "form,, pressure" should be -- form, pressure --.

Signed and Sealed this

Twenty-fifth Day of June, 1996

*Attest:*

Bruce Lehman

BRUCE LEHMAN

*Attesting Officer*

*Commissioner of Patents and Trademarks*